United States Patent [19]

Buckley, III et al.

[11] Patent Number: 4,713,187

[45] Date of Patent: Dec. 15, 1987

[54] LUBRICATING OIL COMPOSITIONS CONTAINING MODIFIED SUCCINIMIDES (V)

[75] Inventors: Thomas F. Buckley, III, Hercules; Robert H. Wollenberg, San Rafael, both of Calif.

[73] Assignee: Chevron Research Company, San Francisco, Calif.

[21] Appl. No.: 20,934

[22] Filed: Mar. 2, 1987

Related U.S. Application Data

[63] Continuation of Ser. No. 819,770, Jan. 26, 1986, Pat. No. 4,647,390, which is a continuation-in-part of Ser. No. 722,910, Apr. 12, 1985, abandoned.

[51] Int. Cl.[4] ..... C10M 133/16

[52] U.S. Cl. ..... 252/49.6; 252/51.5 A; 544/69; 546/13; 549/213; 540/467; 548/405

[58] Field of Search ..... 252/49.6, 51.5 A; 544/69; 540/467; 546/13; 548/405; 549/213

[56] References Cited

U.S. PATENT DOCUMENTS

| | | | |
|---|---|---|---|
| 2,182,178 | 12/1939 | Pinkernelle | 260/326 |
| 2,802,022 | 8/1957 | Grogzos et al. | 260/471 |
| 2,991,162 | 7/1961 | Malec | 44/58 |
| 3,216,936 | 11/1965 | Lesuer | 252/32.7 |
| 3,367,943 | 2/1968 | Miller et al. | 260/326.3 |
| 3,373,111 | 3/1968 | Lesuer et al. | 252/51.5 |
| 3,401,118 | 9/1968 | Benoit, Jr. | 252/51.5 |
| 3,525,693 | 8/1970 | Lyle et al. | 252/34 |
| 3,576,743 | 4/1971 | Widmer et al. | 252/51.5 |
| 3,652,240 | 3/1972 | Dorn et al. | 44/66 |
| 4,098,585 | 7/1978 | Vartanian | 44/63 |
| 4,104,182 | 8/1978 | Chou et al. | 252/51.5 |
| 4,191,537 | 3/1980 | Lewis et al. | 44/71 |
| 4,422,856 | 12/1983 | Maldonado et al. | 44/71 |
| 4,460,381 | 7/1984 | Karol et al. | 44/63 |
| 4,482,464 | 11/1984 | Karol et al. | 252/51.5 A |
| 4,490,154 | 12/1984 | Sung et al. | 44/70 |
| 4,501,597 | 2/1985 | Karol et al. | 44/63 |
| 4,521,318 | 6/1985 | Karol | 252/51.5 A |
| 4,599,183 | 7/1986 | Horodysky et al. | 252/49.6 |
| 4,600,520 | 7/1986 | Horodysky | 252/49.6 |
| 4,647,390 | 3/1987 | Buckley et al. | 252/51.5 A |
| 4,648,886 | 3/1987 | Buckley et al. | 44/63 |

FOREIGN PATENT DOCUMENTS 689705 4/1953 United Kingdom .

*Primary Examiner*—Jacqueline V. Howard

*Attorney, Agent, or Firm*—S. R. La Paglia; R. C. Gaffney; S. L. Biggs

[57] ABSTRACT

Disclosed herein are additives which are useful as dispersants and detergents in lubricating oils and fuels. In particular, this invention is directed toward polyamino alkenyl or alkyl succinimides wherein one or more of the amino nitrogens of the succinimide is substituted with $$R_4OR_5{-}O\overset{O}{\overset{\|}{(C)}}_m\overset{O}{\overset{\|}{C}}{-}$$

wherein $R_4$ is hydrocarbyl of from 1 to 30 carbon atoms; $R_5$ is hydrocarbyl of from 2 to 30 carbon atoms or $-R_6-(OR_6)_p-$ wherein $R_6$ is alkylene of 2 to 5 carbon atoms and p is an integer from 1 to 100; and m is an integer of from 0 to 1.

29 Claims, No Drawings

LUBRICATING OIL COMPOSITIONS CONTAINING MODIFIED SUCCINIMIDES (V)

CROSS-REFERENCE TO RELATED APPLICATIONS

This application is a continuation of U.S. Ser. No. 819,770, filed Jan. 26, 1986, now U.S. Pat. No. 4,647,390, which in turn is a continutation-in-part of U.S. Ser. No. 722,910, filed Apr. 12, 1985, which is now abandoned.

BACKGROUND OF THE INVENTION 1. Field of the Invention

This invention relates to additives which are useful as dispersant and/or detergents in lubricating oils and fuels. In particular, this invention is directed toward polyamino alkenyl or alkyl succinimides wherein one or more of the nitrogens of the polyamino moiety is substituted with $$R_4OR_5O\overset{O}{\overset{\|}{(C)}}_m\overset{O}{\overset{\|}{C}}-$$

wherein $R_4$ is hydrocarbyl of from 1 to 30 carbon atoms; $R_5$ is selected from the group consisting of hydrocarbyl of from 2 to 30 carbon atoms and $-R_6-(OR_6)p-$ wherein $R_6$ is alkylene of 2 to 5 carbon atoms and p is an integer from 1 to 100 and m is an integer of from 0 to 1.

The modified polyamino alkenyl or alkyl succinimides of this invention have been found to possess dispersancy and/or detergency properties when employed in a lubricating oil. These modified succinimides are also useful as detergents and/or dispersants in fuels. 2. Prior Art Alkenyl or alkyl succinimides have been previously modified with alkylene oxides to produce poly(oxyalkylene)hydroxy derivatives thereof. These alkylene oxide treated succinimides are taught as additives for lubricating oils (see U.S. Pat. Nos. 3,373,111 and 3,367,943). U.S. Pat. No. 2,991,162 discloses carburetor detergent additives for gasoline obtained by reacting an N-alkyl propylene diamine with ethylene carbonate to produce a two-component detergent additive consisting of a carbamate and a urea compound. U.S. Pat. No. 3,652,240 discloses carburetor detergent additives for hydrocarbonaceous fuel which are carbamates formed by the reaction of an carbonate. Karol et al, U.S. Pat. Nos. 4,501,597 and 4,460,381, disclose that the reaction product of oxalic acid with a mono- or bis-succinimide is useful as a fuel stabilizer and as a carburetor detergent. U.S. Pat. No. 4,482,464 discloses succinimides which have been modified by treatment with a hydroxyalkylene carboxylic acid selected from glycolic acid, lactic acid, 2-hydroxymethyl propionic acid and 2,2'-bis-hydroxymethylpropionic acid. These modified succinimides of U.S. Pat. No. 4,482,464 are disclosed as lubricating oil additives. U.S. Pat. No. 4,490,154 discloses fuels containing an alkenylsuccinyl polyglycol-carbonate ester is a deposit control additive. U.S. Pat. No. 3,216,936 discloses a product prepared from an aliphatic amine, a polymer substituted succinic acid and an aliphatic monocarboxylic acid. U.S. Pat. No. 4,191,537, among others, discloses hydrocarbyl capped poly(oxyalkylene) polyamino carbamates useful as dispersants and detergents or fuels and lubricating oils. However, there is no teaching in these patents, or apparently elsewhere, to modify these polyamino alkenyl or alkyl succinimides in the manner of this invention.

SUMMARY OF THE INVENTION

It has now been found that polyamino alkenyl or alkyl succinimides may be modified to yield a polyamino alkenyl or alkyl succinimide wherein one or more of the basic nitrogens of the polyamino moiety is substituted with $$R_4OR_5O\overset{O}{\overset{\|}{(C)}}_m\overset{O}{\overset{\|}{C}}-$$

wherein $R_4$ is hydrocarbyl of from 1 to 30 carbon atoms; $R_5$ is selected from the group consisting of hydrocarbyl of from 2 to 30 carbon atoms or $-R_6-OR_6-_p$ wherein $R_6$ is alkylene of from 2 to 5 carbon atoms and p is an integer from 1 to 100; and m is an integer from 0 to 1. These modified succinimides are dispersants and/or detergents for use in fuels or oils. Accordingly, the present invention also relates to a lubricating oil composition comprising a major amount of an oil of lubricating viscosity and an amount of a modified polyamino alkenyl or alkyl succinimide sufficient to provide dispersancy and/or detergency.

Another composition aspect of this invention is a fuel composition comprising a major portion of a hydrocarbon boiling in a gasoline or diesel range and an amount of a modified polyamino alkenyl or alkyl succinimide sufficient to provide dispersancy and/or detergency.

Preferably $R_4$ is hydrocarbyl of from 2 to 20 carbon atoms while $R_5$ is preferably a straight- or branched-chain alkylene group of from 2 to about 30 carbon atoms or a straight- or branched-chain alkylene group of from 2 to about 30 carbon atoms substituted with aryl of from 6 to 10 carbon atoms or alkaryl of from 7 to 12 carbon atoms. Most preferably, $R_5$ is a straight- or branched-chain alkylene group of from 2 to about 30 carbon atoms.

Preferably p is an integer from 1 to 50; more preferably p is an integer from 2 to 30 and most preferably p is an integer from 2 to 20 while $R_6$ is preferably a $C_2$–$C_4$ alkylene group.

In general, the alkenyl or alkyl group of the succinimide is from 10 to 300 carbon atoms While.the modified succinimides of this invention possess good detergency properties even for alkenyl or alkyl groups of less than 20 carbon atoms, dispersancy is enhanced when the alkenyl or alkyl group is at least 20 carbon atoms. Accordingly, in a preferred embodiment, the alkenyl or alkyl group of the succinimide is at least 20 carbon atoms (i.e., the alkenyl or alkyl group is from 20 to 300 carbon atoms).

Hydrocarbyl, as used in describing the $R_4$ and $R_5$ groups, denotes an organic radical composed of carbon and hydrogen which may be aliphatic, aromatic or combinations thereof, e.g., aralkyl, alkaryl. Suitable hydrocarbyls are alkyls such as ethyl, propyl, etc.; alkenyls such as propenyl, isobutenyl, etc.; aralkyl such as benzyl, etc.; alkaryl such as dodecylphenyl ($C_{12}H_{25}-C_6H_4-$), etc.; and aryls such as phenyl, napthyl, etc.

A straight- or branched-chain alkylene group of from 2 to about 30 carbon atoms refers to straight-chain alkylene groups such as 1,2-ethylene; 1,3-propylene, 1,5-pentylene, 1,20-eicosylene, 1-30,tricontylene; etc., and branched-chain alkylene groups such as 1,2-propylene;

1,3-butylene; 1,2-(2-methyl)pentylene; 1,2[(2ethyl)hexylene; 1,10-eicosylene; etc.

A straight- or branched-chain alkylene group of from 2 to about 30 carbon atoms substituted with aryl of from 6 to 10 carbon atoms or alkaryl of from 7 to 12 carbon atoms refers to the above-described straight- or branched-chain alkylene groups substituted with an aryl or an alkaryl group. Suitable aryls include phenyl, napthyl, etc. Suitable alkaryls include benzyl, etc

DETAILED DESCRIPTION OF THE INVENTION

The modified polyamino alkenyl or alkyl succinimides of this invention are prepared from a polyamino alkenyl or alkyl succinimide. In turn, these materials are prepared by reacting an alkenyl or alkyl succinic anhydride with a polyamine as shown below:

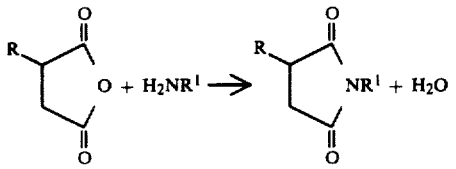

I wherein R is an alkenyl or alkyl group of from 10 to 300 carbon atoms; and $R^1$ is the remainder of the polyamino moiety.

These alkenyl or alkyl succinimides that can be used herein are disclosed in numerous references and are well known in the art. Certain fundamental types of succinimides and related materials encompassed by the term of art "succinimide" are taught in U.S. Pat. Nos. 2,992,708; 3,018,291; 3,024,237; 3,100,673; 3,219,666; 3,172,892; and 3,272,746, the disclosures of which are hereby incorporated by reference. The term "succinimide" is understood in the art to include many of the amide, imide and amidine species which are also formed by this reaction. The predominant product however is succinimide and this term has been generally accepted as meaning the product of a reaction of an alkenyl substituted succinic acid or anhydride with a polyamine as shown in reaction (1) above. As used herein, included within this term are the alkenyl or alkyl mono-, bis-succinimides and other higher analogs.

A(1) Succinic Anhydride

The preparation of the alkenyl-substituted succinic anhydride by reaction with a polyolefin and maleic anhydride has been described, e.g., U.S. Pat. Nos. 3,018,250 and 3,024,195. Such methods include the thermal reaction of the polyolefin with maleic anhydride and the reaction of a halogenated polyolefin, such as a chlorinated polyolefin, with maleic anhydrde Reduction of the alkenyl-substituted succinic anhydride yields the corresponding alkyl derivative. Alternatively, the alkenyl substituted succinic anhydride may be prepared as described in U.S. Pat. Nos. 4,388,471 and 4,450,281 which are totally incorporated herein by reference.

Polyolefin polymers for reaction with the maleic anhydride are polymers comprising a major amount of $C_2$ to $C_5$ mono-olefin, e.g., ethylene, propylene, butylene, isobutylene and pentene. The polymers can be homopolymers such as polyisobutylene as well as copolymers of 2 or more such olefins such as copolymers of: ethylene and propylene, butylene, and isobutylene, etc. Other copolymers include those in which a minor amount of the copolymer monomers, e.g., 1 to 20 mole percent is a $C_4$ to $C_8$ nonconjugated diolefin, e.g., a copolymer of isobutylene and butadiene or a copolymer of ethylene, propylene and 1,4-hexadiene, etc.

The polyolefin polymer, represented in FIG. 1 as R, usually contains from about 10 to 300 carbon atoms, although preferably 20 to 300 carbon atoms. Other preferred embodiments include 12 to 100 carbon atoms and more preferably 20 to 100 carbon atoms.

A particularly preferred class of olefin polymers comprises the polybutenes, which are prepared by polymerization of one or more of 1-butene, 2-butene and isobutene. Especially desirable are polybutenes containing a substantial proportion of units derived from isobutene. The polybutene may contain minor amounts of butadiene which may or may not be incorporated in the polymer. Most often the isobutene units constitute 80%, preferably at least 90%, of the units in the polymer. These polybutenes are readily available commercial materials well known to those skilled in the art. Disclosures thereof will be found, for example, in U.S Pat. Nos. 3,215,707; 3,231,587; 3,515,669; and 3,579,450, as well as U.S. Pat. No. 3,912,764. The above are incorporated by reference for their disclosures of suitable polybutenes.

In addition to the reaction of a polyolefin with maleic anhydride, many other alkylating hydrocarbons may likewise be used with maleic anhydride to produce alkenyl succinic anhydride. Other suitable alkylating hydrocarbons include cyclic, linear, branched and internal or alpha olefins with molecular weights in the range 100–4,500 or more with molecular weights in the range of 200–2,000 being more preferred. For example, alpha olefins obtained from the thermal cracking of paraffin wax. Generally, these olefins range from 5–20 carbon atoms in length. Another source of alpha olefins is the ethylene growth process which gives even number carbon olefins. Another source of olefins is by the dimerization of alpha olefins over an appropriate catalyst such as the well known Ziegler catalyst. Internal olefins are easily obtained by the isomerization of alpha olerins over a suitable catalyst such as silica.

A(2) Polyamine

The polyamine employed to prepare the polyamino alkenyl or alkyl succinimides is preferably a polyamine having from 2 to about 12 amine nitrogen atoms and from 2 to about 40 carbon atoms. The polyamine is reacted with an alkenyl or alkyl succinic anhydride to produce the polyamino alkenyl or alkyl succinimide, employed in this invention. The polyamine is so selected so as to provide at least one basic amine per succinimide. The polyamine preferably has a carbon-to-nitrogen ratio of from about 1:1 to about 10:1.

Since the conversion of the basic amine is believed to efficiently go through a primary or secondary amine, at least one of the basic amine nitrogens of the polyamine moiety must be either a primary or secondary amine.

The polyamino portion of the polyamino alkenyl or alkyl succinimide may be substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower", as used in terms like lower alkyl or lower alkoxy, means a group containing from 1 to about 6 carbon atoms.

Hydrocarbyl, as used in describing the polyamine components of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, 2-(2-ethoxyethoxy)ethyl, 2-[2-(2-ethoxyethoxy)ethoxy]ethyl, 3,6,9,12-tetraoxatetradecyl, 2-(2-ethoxyethoxy)hexyl, etc. The acyl groups of the aforementioned (C) substituents are such as propionyl, acetyl, etc. The more preferred substituents are hydrogen, $C_1$–$C_6$ alkyls, and $C_1$–$C_6$ hydroxyalkyl.

In a substituted polyamine the substituents are found at any atom capable of receiving them. The substituted atoms, e.q., substituted nitrogen atoms, are qenerally qeometrically inequivalent, and consequently the substituted amines finding use in the present invention can be mixtures of mono- and polysubstituted polyamines with substituent groups situated at equivalent and/or inequivalent atoms.

The more preferred polyamine finding use within the scope of the present invention is a polyalkylene polyamine, including alkylene diamine, and including substituted polyamines, e.g., alkyl substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethylpeopylene, trimethylene, etc. Examples of such polyaminess include ethylene diamine, diethylene triamine, di(trimethylene)triamine, dipropylene triamine, triethylene tetramine, tripropylene tetramine, tetraethylene pentamine, and pentaethylene hexamine. Such amines encompass isomers such as branched-chain polyamines and the previously mentioned substituted polyamines, including hydrocarbyl-substituted polyamines. Among the polyalkylene polyamines, those containing 2–12 amine nitrogen atoms and 2–24 carbon atoms are especially preferred, and the $C_2$–$C_5$ alkylene polyamines are most preferred, in particular, the lower polyalkylene polyamines, e.g., ethylene diamine, dipropylene triamine, etc.

The polyamine component also may contain heterocyclic polyamines, heterocyclic substituted amines and substituted heterocyclic compounds, wherein the heterocycle comprises one or more 5–6 membered rings containing oxygen and/or nitrogen. Such heterocycles may be saturated or unsaturated and substituted with groups selected from the aforementioned (A), (B), (C) and (D). The heterocycles are exemplified by piperazines, such as 2-methylpiperazine, 1,2-bis-(N-piperazinyl)ethane, and N,N'-bis(N-piperazinyl)piperazine, 2-methylimidazoline, 3-aminopiperidine, 2-aminopyridine, 2-(3-aminoethyl)-3-pyrroline, 3-aminopyrrolidine, N-(3-aminopropyl)morpholine, etc. Among the heterocyclic compounds, the piperazines are preferred.

Typical polyamines that can be used to form the compounds of this invention include the following: ethylene diamine, 1,2-propylene diamine, 1.3-propylene diamine, diethylene triamine, triethylene tetramine, hexamethylene diamine, tetraethylene pentamine, methylaminopropylene diamine, N-(betaaminoethyl)piperazine, N,N'-di(betaaminoethyl)piperazine, N,N'-di(beta aminoethyl)imidazolidone-2, N-(beta-cyanoethyl)ethane-1,2-diamine, 1,3,6,9-tetraaminooctadecane, 1,3,6-triamino-9-oxadecane, N-methyl-1,2-propanediamine, 2-(2-aminoethylamino)ethanol.

Another group of suitable polyamines are the propyleneamines, (bisaminopropylethylenediamines). Propyleneamines are prepared by the reaction of acrylonitrile with an ethyleneamine, for example, an ethyleneamine having the formula $H_2N(CH_2CH_2NH)_ZH$ wherein Z is an integer from 1 to 5, followed by hydrogenation of the resultant intermediate. Thus, the product prepared from ethylene diamine and acrylonitrile would be $H_2N(CH_2)_3NH(CH_2)_2NH(CH_2)_3NH_2$.

In many instances the polyamine used as a reactant in the production of succinimides of the present invention is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine, substituted piperazines and pentaethylene hexamine, but the composition will be largely tetraethylene pentamine and the empirical formula of the total amine composition will closely approximate that of tetraethylene pentamine. Finally, in preparing the succinimide for use in this invention, where the various nitrogen atoms of the polyamine are not geometrically equivalent, several substitutional isomers are possible and are encompassed within the final product. Methods of preparation of polyamines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volumes 2, pp. 99–116.

The reaction of a polyamine with an alkenyl or alkyl succinic anhydride to produce the polyamino alkenyl or alkyl succinimides is well known in the art and is disclosed in U.S. Pat. Nos. 2,992,708; 3,018,291; 3,024,237; 3,100,673; 3,219,666; 3,172,892 and 3,272,746. The above are incorporated herein by reference for their disclosures of preparing alkenyl or alkyl succinimides.

As noted above, the term "polyamino alkenyl or alkyl succinimide" refers to both polyamino alkenyl or alkyl mono- and bis-succinimides and to the higher analogs of polyamino alkenyl or alkyl poly succinimides. Preparation of the bis- and higher analogs may be accomplished by controlling the molar ratio of the reagents. For example, a product comprising predominantly mono- or bis-succinimide can be prepared by controlling the molar ratios of the polyamine and succinic anhydride. Thus, if one mole of polyamine is reacted with one mole of an alkenyl or alkyl substituted succinic anhydride, a predominantly mono-succinimide product will be prepared If two moles of an alkenyl or alkyl substituted succinic anhydride are reacted per mole of polyamine, a bis-succinimide is prepared. Higher analogs may likewise be prepared.

A particularly preferred class of polyamino alkenyl or alkyl succinimides employed in the instant invention may be represented by Formula II:

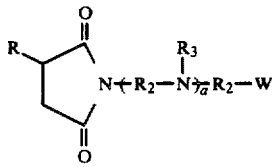

II wherein R is alkenyl or alkyl of from 10 to 300 carbon atoms; $R_2$ is alkylene of 2 to 10 carbon atoms; $R_3$ is hydrogen, lower alkyl or lower hydroxy alkyl; a is an integer from 0 to 10; and W is $—NH_2$ or represents a group of Formula III:

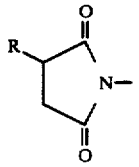

III wherein R is alkenyl or alkyl of from 10 to 300 carbon atoms; with the proviso that when W is the group of Formula III above, then a is not zero and at least one of $R_3$ is hydrogen.

As indicated above, the polyamine employed in preparing the succinimide is often a mixture of different compounds having an average composition indicated as the Formula II. Accordingly, in Formula II each value of $R_2$ and $R_3$ may be the same as or different from other $R_2$ and $R_3$.

Preferably R is alkenyl or alkyl of from 20 to 300 carbon atoms. In another preferred embodiment, R is preferably 12 to 100 carbon atoms and more preferably 20 to 100 carbon atoms.

Preferably, $R_2$ is alkylene of 2 to 6 carbon atoms and most preferably is either ethylene or propylene.

Preferably, $R_3$ is hydrogen or lower alkyl.

Preferably, a is an integer from 1 to 6.

In formula II, the polyamino alkenyl or alkyl succinimides may be conveniently viewed as being composed of three moieties that is the alkenyl or alkyl moiety R, the succinimide moiety represented by the formula:

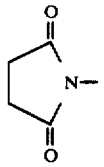

and the polyamino moiety represented by the group

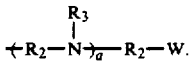

The preferred alkylene polyamines employed in this reaction are generally represented by the formula:

$$H_2N—R_2NH)_a—R_2NH_2$$

wherein $R_2$ is an alkylene moiety of 2 to 10 carbon atoms and a is an integer from about 0 to 10. However, the preparation of these alkylene polyamines do not produce a single compound and cyclic heterocycles, such as piperazine, may be included to some extent in the alkylene diamines.

B. MODIFIED SUCCINIMIDES

The polyamino alkenyl or alkyl succinimides wherein one or more of the nitrogens of the polyamino moiety is substituted with

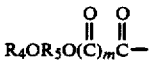

wherein $R_4$, $R_5$ and m are as defined above, are prepared by reacting a polyamino alkenyl or alkyl succinimide, IV, with a chloroformate, V, as shown in reaction (1) below:

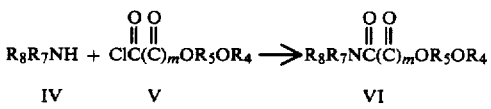

(1)

wherein $R_8$ and $R_7$ form the remainder of a polyamino alkenyl or alkyl succinimide and $R_4$, $R_5$ and m are as defined above.

Reaction (1) is conducted by contacting the chloroformate, V, with the polyamino alkenyl or alkyl succinimide, IV. The reaction may be conducted neat or in a suitable inert diluent. Suitable diluenrs include ethyl acetate, toluene, xylene, oil and the like. An organic base such as pyridine, triethylamine and the like may be added to the reaction to scavenge the acid generated. However, the generated acid may also be removed by an alkaline water wash (pH of from 8–9 or higher) or an alkaline brine wash (pH of from 8–9 or higher) of the reaction solution after reaction completion without the need of added base. The reaction is generally conducted at from 0° C. to 50° C. and is generally complete from within 0.5 to 24 hours. Afterwards, the product may be further isolated by conventional techniques such as chromatography, filtration and the like. If the succinimide contains hydroxyalkyl, use of lower temperature (−78° C. to 0° C.) helps prevent carbonate formation. Carbonates may be removed via reaction with an amine of the succinimide or an alcohol (i.e., ethanol) under transesterification conditions.

Preferably, it is desirable to substitute at least 20% of the amines with

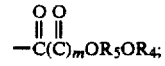

more preferably at least 50% of the amines should be converted; and most preferably all of the amines capable of reaction should be converted.

In general, maximum conversion of the reactive amines of the polyamino alkenyl or alkyl succinimide can be obtained by employing a molar charge of chloroformate to the theoretical basic nitrogen of the alkenyl or alkyl succinimide of from 0.7:1 to about 1:1. In some cases, a slight excess of chloroformate may be employed to enhance reaction rate.

Alternatively, the products of this invention are also prepared by reacting a polyaminoalkenyl or alkyl succinimide, IV, with an aryl carbonate as shown in reaction 1(a) below:

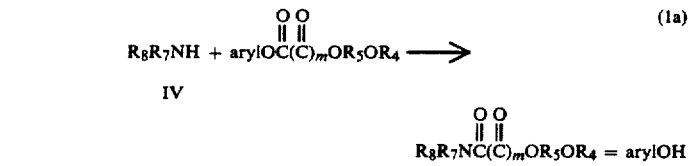

(1a)

IV VI wherein $R_4$, $R_5$, $R_7$, $R_8$ and m are as defined above and aryl is preferably phenyl or substituted phenyl such as p-nitrophenyl, p-chlorophenyl, etc.

Reaction (1a) is conducted by contacting the aryl carbonate with the polyamino alkenyl or alkyl succinimide, IV. The reaction may be conducted neat or in a suitable inert diluent. Suitable diluents include toluene, xylene, thinners, oil, and the like. The reaction is generally conducted at from 50° C. to 150° C. and is generally complete from within 1 to 4 hours. Afterwards, the product may be further isolated by conventional techniques such as stripping, chromatography, filtration, and the like.

The aryl carbonate is prepared via conventional processes from the aryl alcohol and the choroformate, V, under conditions known per se.

The chloroformates of formula V are prepared as shown in reaction (2) below:

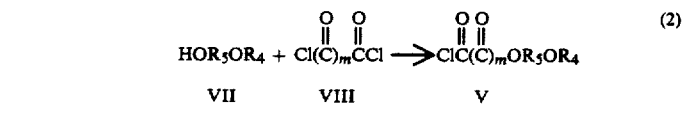

(2)

VII VIII V wherein $R_5$ and $R_4$ are as defined above.

This reaction is a conventional process well known in the art and may be conducted by employing phosgene (m=0) or oxalyl chloride (m=1) generally in excess. The reaction is conducted by adding the alcohol, VII, to a suitable diluent such as toluene, benzene,-methylene chloride, and the like. Phosgene or oxaly chloride is then added to the system over a period of time. Alternatively, the phosgene or oxalyl chloride may be added to the diluent prior to addition of the alcohol. In general, approximately 1.1-2.5 equivalents of phosgene or oxalyl chloride is added per equivalent of alcohol, VII. The reaction is conducted at from −78° to 50° C., preferably −10° to 10° C., and is generally complete from within ½ to 12 hours. The chloroformate, V, may be isolated by conventional techniques such as distillation but preferably the system is stripped of a portion of the inert diluent which also removes hydrogen chloride gas generated and excess reagent, VIII. The product, V, contained in the remaining diluent is then used as is reaction (1) above.

As used herein, the term "chloroformate" includes both the chloroformate (m=0 of formula V) and the chlorodicarbonyloxy analogs (m=1 of formula V).

As used herein, the term "molar charge of chloroformate to the basic nitrogen of a polyamino alkenyl or alkylsuccinimide" means that the molar charge of chloroformate employed in the reaction is based upon the theoretical number of basic nitrogens contained in the succinimide. Thus, when 1 equivalent of triethylene tetraamine (TETA) is reacted with an equivalent of succinic anhydride, the resulting monosuccinimide will theoretically contain 3 basic nitrogens. Accordingly, a molar charge of 1 would require that a mole of chloroformate be added for each basic nitrogen or in this case 3 moles of chloroformate for each mole of monosuccinimide prepared from TETA.

The alcohols, VII, are either commercially available or may be readily prepared by knbwn processes. For instance, hydrocarbyl capped poly(oxyalkylene) monools (i.e., $R_5 = -R_6(OR_6)m$ are described in U.S Pat. No. 4,191,537.

These hydrocarbyl-terminated poly(oxyalkylene) polymers, which are utilized in preparing the chloroformates used in the present invention are monohydroxy compounds, i.e., alcohols, often termed monohydroxy polyethers, or polyalkylene glycol monohydrocarbylethers, or "capped" poly(oxyalkylene) glycols and are to be distinguished from the poly(oxyalkylene) glycols (diols), or polyols, which are not hydrocarbyl-terminated, i.e., not capped. The hydrocarbyl-terminated poly(oxyalkylene) alcohols are produced by the addition of lower alkylene oxides, such as oxirane, ethylene oxide, propylene oxide, the butylene oxides, or the pentylene oxides to the hydroxy compound $R_6OH$ under polymerization conditions, wherein $R_6$ is the hydrocarbyl group which caps the poly(oxyalkylene) chain. Methods of production and properties of these polymers are disclosed in U.S. Pat. Nos. 2,841,479 and 2,782,240 and the aforementioned Kirk-Othmer's "Encyclopedia of Chemical Technology," Volume 19, p. 507. In the polymerization reaction a single type of alkylene oxide may be employed, e.g., propylene oxide, in which case the product is a homopolymer, e.g., a poly(oxypropylene) propanol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention. Random polymers are more easily prepared when the reactivities of the oxides are relatively equal. In certain cases, when ethylene oxides is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. A particular block copolymer is represented by a polymer prepared by polymerizing propylene oxide on a suitable monohydroxy compound to form a poly(oxypropylene) alcohol and then polymerizing butylene oxide on the poly(oxypropylene) alcohol.

In general, the poly(oxyalkylene) polymers are mixtures of compounds that differ in polymer chain length. However, their properties closely approximate those of the polymer represented by the average composition and molecular weight.

The hydrocarbylpoly(oxyalkylene) moiety of the chloroformate is composed of oxyalkylene units containing from 2 to about 5 carbon atoms. The hydrocarbyl group contains from 1 to about 30 carbon atoms, preferably from 2 to about 20 carbon atoms. Preferably the oxyalkylene units contain from 3 to 4 carbon atoms and the molecular weight of the hydrocarbyl poly(oxyalkylene) moiety is from about 44 to about 10,000, more preferably from about 100 to about 5,000. Each poly(oxyalkylene) polymer contains from 1 to 100 oxyalkylene units, preferably 2 to about 50 oxyalkylene units, more preferably about 2 to 30 units and most preferably 2 to about 20 such units. In general, the oxyalkylene units may be branched or unbranched. The structures of the $C_3$–$C_5$ oxyalkylene units are any of the isomeric structures well known to the organic chemist, e.g., n-propylene, $-CH_2CH_2CH_2-$; isopropylene, $-C(CH_3)CH_2-$; n-butylene, $-CH_2CH_2CH_2CH_2-$; sec.-butylene, $-CH(CH_2CH_3)CH_2-$; tert.—butylene, $-C(CH_3)_2CH_2-$; disec.-butylene, $-CH(CH_3)CH(CH_3)-$; isobutylene, $-CH_2CH(CH_3)CH_2-$; etc. The preferred poly(oxyalkylene) compounds are composed of from 1 to about 50 oxyalkylene units, more preferably about 2 to 30 oxyalkylene units and most preferably 2 to about 20 such units.

The hydrocarbyl moiety (R-) which terminates the poly(oxyalkylene) chain contains from 1 to about 30 carbon atoms, preferably from 2 to about 20 carbon atoms, and is generally derived from the monohydroxy compound (ROH) which is the initial site of the alkylene oxide addition in the polymerization reaction. Such monohydroxy compounds are preferably aliphatic or aromatic alcohols of from 1 to about 30 carbon atoms, more preferably an alkanol or an alkylphenol, and most preferably an alkylphenol wherein the alkyl is a straight or branched chain of from 1 to about 24 carbon atoms. One such preferred alkyl group is obtained by polymerizing propylene to an average of 4 units and has the common name of propylene tetramer. The preferred material may be termed either an alkylphenylpoly(oxyalkylene) alcohol or a polyalkoxylated alkylphenol.

Likewise, hydrocarbyloxyhydrocarbyl alcohols (i.e., $R_5$=hydrocarbyl in formula VII above) may be prepared from the corresponding glycol by art recognized techniques as shown in reactions (3)–(6) below:

$$\underset{\text{IX}}{HOR_5OH} + \underset{\text{X}}{CH_3\overset{O}{\overset{\|}{C}}OH} \longrightarrow \underset{\text{XI}}{HOR_5O\overset{O}{\overset{\|}{C}}CH_3} + H_2O \quad (3)$$

$$\text{XI} + Na\ (\text{or } K) \longrightarrow \underset{\text{XII}}{Na^{+-}OR_5O\overset{O}{\overset{\|}{C}}CH_3} \quad (4)$$

$$\underset{\text{XIII}}{R_4Cl} + \text{XII} \longrightarrow \underset{\text{XIV}}{R_4OR_5O\overset{O}{\overset{\|}{C}}CH_3} \quad (5)$$

$$\text{XIV} + \text{base} \longrightarrow \underset{\text{VII}}{R_4OR_5OH} \quad (6)$$

wherein $R_4$ and $R_5$ are as defined above and base is an inorganic base such as potassium bicarbonate, sodium carbonate, sodium hydroxide and the like. Each of reactions (3)–(6) is a well known and art recognized process.

Reaction (3) is a conventional esterification reaction and is conducted by combining the diol, IX, with the acid, X, to yield the monoester XI. Although acetic acid is employed in reaction (3), any suitable carboxylic acid such as trichloroacetic acid, propionic acid, benzoic acid, and the like, may be utilized to form the monoester, XI. In some instances, an acid catalyst such as sulfuric, hydrochloric and the like may be employed to enhance the reaction rate. In order to prevent formation of a diester, an excess of diol, IX, is employed. In general, from 1.1 to 4 equivalents of diol, IX, and preferably 2 equivalents per equivalent of acid, X, are employed in reaction (3). The reaction may be conducted neat or in a suitable diluent such as toluene, benzene and the like. The water generated during the reaction may be readily removed via a Dean-Stark trap. The product ester, XI, may be isolated by conventional techniques such as chromatography, filtration and the like or used in reaction (4) without purification.

Reaction (4) is a conventional reaction of an alcohol with metallic sodium or potassium to form a sodium or potassium salt. Alternatively, potassium t-butoxide may be employed in place of metallic sodium or potassium. The reaction is generally conducted by adding an equimolar amount of the metallic sodium or potassium to the alcohol which is generally contained is an anhydrous inert diluent such as tetrahydrofuran, dioxane, toluene and the like. The reaction is generally conducted at from 0° to 60° C. and is generally complete from within 1 to 24 hours. The resulting salt, XII, is generally employed in reaction (5) without isolation and/or purification.

Reaction (5) is a metathesis reaction to form the ethers, XIV. The reaction is generally conducted by adding an equimolar amounts of the hydrocarbyl chloride, XIII to the sodium (or potassium) salt, XII. The reaction is generally conducted in an inert diluent such as toluene, dioxane and the like. The reaction is generally conducted at from 0° to 110° C. and is generally complete from with 1 to 24 hours. The resulting ether-ester, XIV, may be isolated by conventional techniques such as chromatography, filtration and the like or used in reaction (6) without purification.

Reaction (6) is a conventional hydrolysis reaction to form the alcohol-ether, VII. The reaction is conducted by adding the ether-ester, XIV, to an aqueous alcohol solvent such as water/methanol, water/ethanol and the like. An inorganic base, such as sodium carbonate, sodium hydroxide, potassium bicarbonate and the like, is added to the reaction. The reaction is generally conducted at from room temperature to about 80° C. and is generally complete from within 1 to 24 hours. The resulting alcohol-ether, VII may then be isolated by conventional techniques such as chromatography, filtration, distillation and the like.

The hydrocarbyl chloride, XIII, may be prepared from the corresponding alcohol via a chlorinating agent such as thionyl chloride. This reaction is well known and is described by Buehler and Pearson, Survey of Organic Synthesis, Vol. 1, pp. 330–332, Wiley & Sons, N.Y. (1978).

Accordingly, by employing chloroformate, V, and a polyamino alkenyl or alkyl succinimide of formula II above in reaction (1) above, compounds of the following formula are produced:

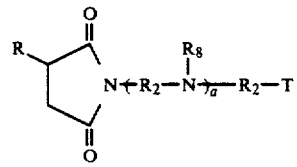

wherein R is alkenyl or alkyl of from 10 to 300 carbon atoms; $R_2$ is alkylene of from 2 to 10 carbon atoms; a is an integer from 0 to 10; $R_8$ is hydrogen, lower alkyl of from 1 to 6 carbon atoms, lower hydroxy alkyl of from 1 to 6 carbon atoms, and $$-\overset{O}{\overset{\|}{C}}(\overset{O}{\overset{\|}{C}})_m OR_5 OR_4$$

wherein m is an integer from 0 to 1, $R_4$ is hydrocarbyl or from 1 to 30 carbon atoms, $R_5$ is a straight- or branched-chain alkylene group of from 2 to about 30 carbon atoms, a straight- or branched-chain alkylene group of from 2 to about 30 carbon atoms substituted with aryl of from 6 to 10 carbon atoms or alkaryl of from 7 to 12 carbon atoms, or $-R_6(OR_6)_p-$ wherein $R_6$ is alkylene of from 2 to 5 carbon atoms and p is an integer from 1 to 100; T is

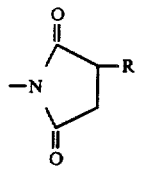

or $-NHR_8$ wherein R and $R_8$ are as above defined with the proviso that at least one of $R_8$ is $$-\overset{O}{\overset{\|}{C}}(\overset{O}{\overset{\|}{C}})_m OR_5 OR_4.$$

Preferably R is alkenyl or alkyl of from about 20 to 100 carbon atoms. Preferably $R_2$ is alkylene of from 2 to 6 carbon atoms; a is an integer from 1 to 6. Preferred $R_8$ is $$-\overset{O}{\overset{\|}{C}}(\overset{O}{\overset{\|}{C}})_m OR_5 OR_4$$

while preferred $R_4$ is hydrocarbyl of from 1 to 20 carbon atoms. Preferably $R_5$ is $-R_6(OR_6)p-$; and p is an integer from 2 to 30.

The modified succinimides of this invention can be reacted at a temperature sufficient to cause reaction with boric acid or a similar boron compound to form borated dispersants having utility within the scope of this invention. In addition to boric acid (boron acid), examples of suitable boron compounds include boron oxides, boron halides and esters of boric acid. Generally from about 0.1 equivalents to 10 equivalents of boron compound to the modified succinimide may be employed.

The modified polyamino alkenyl or alkyl succinimides of this invention are useful as detergent and dispersant additives when employed in lubricating oils. When employed in this manner, the modified polyamino alkenyl or alkyl succinimide additive is usually present in from 0.2 to 10 percent by weight to the total composition and preferably at about 0.5 to 5 percent by weight. The lubricating oil used with the additive compositions of this invention may be mineral oil or synthetic oils of lubricating viscosity and preferably suitable for use in the crankcase of an internal combustion engine. Crankcase lubricating oils ordinarily have a viscosity of about 1300 CSt 0° F. to 22.7 CSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene, can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Additive concentrates are also included within the scope of this invention. The concentrates of this invention usually include from about 90 to 10 weight percent of an oil of lubricating viscosity and from about 10 to 90 weight percent of the complex additive of this invention. Typically, the concentrates contain sufficient diluent to make them easy to handle during shipping and storage. Suitable diluents tor the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), althouqh an oil of lubricating viscosity may be used.

Other additives which may be present in the formulation include rust inhibitors, foam inhibitors, corrosion inhibitors, metal deactivators, pour point depressants, antioxidants, and a variety of other wellknown additives.

It is also contemplated the modified succinimides of this invention may be employed as dispersants and detergents in hydraulic fluids, marine crankcase lubricants and the like. When so employed, the modified succinimide is added at from abouL 0.1 to 10 percent by weight to the oil. Preferably, at from 0.5 to 5 weight percent.

When used in fuels, the proper concentration of the additive necessary in order to achieve the desired detergency is dependent upon a variety of factors including the type of fuel used, the presence of other detergents or dispersants or other additives, etc. Generally, however, and in the preferred embodiment, the range of concentration of the additive in the base fuel is 10 to 10,000 weight parts per million, preferably from 30 to 2,000 weight parts per million, and most preferably from 30 to 700 parts per million of the modified succinimide per part of base fuel. If other detergents are present, a lesser amount of the modified succinimide may be used.

The modified succinimide additives of this invention may be formulated as a fuel concentrate, using an inert stable oleophilic organic solvent boiling in the range of about 150° to 400° F. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the fuel additive. In the fuel concentrate, the amount of the additive will be ordinarily at least 10 percent by weight and generally not exceed 70 percent by weight and preferably from 10 to 25 weight percent.

The following examples are offered to specifically illustrate this invention. These examples and illustrations are not to be construed in any way as limiting the scope of this invention.

EXAMPLES

EXAMPLE 1

Into a 1 liter three-neck flask equipped with a mechanical stirrer and nitrogen sweep was placed 200 ml of methylene chloride containing 18.9 g of oxalylchloride. To this mixture at room temperature was added dropwise a solution of methylene chloride containing 165 g (0.10 mole) of tetrapropenylphenyl polyoxbutylene alcohol ($C_{12}H_{25}—C_6H_4—O(C_4H_9O)_{\sim 18}H$) over 30 minutes. Upon completion of addition, the solution was stripped to remove methylene chloride and excess oxalyl chloride yielding the chlorodicarbonyloxy derivative $$(C_{12}H_{25}—C_6H_4—O(C_4H_9O)_{\sim 18}\overset{O}{\overset{\|}{C}}\overset{O}{\overset{\|}{C}}Cl).$$

The chlorodicarbonyloxy derivative was then redissolved in 300 ml methylene chloride.

The methylene chloride solution containing the chlorodicarbonyloxy derivative was then added to a composition containing 200 ml methylene chloride, 30 ml triethylamine and 406 g of a succinimide dispersant composition [prepared by reacting 1 mole of polyisobutenyl succinic anhydride, where the polyisobutenyl group has a number average molecular weight of about 950, with 0.87 mole of tetraethylene pentaamine; then diluting to about 35% actives with diluent oil]. The system was stirred at room temperature for 2 hours afterwards, the system was partially stripped, diluted with 1 liter hexane, extracted twice with brine (pH 8–9), dried ($MgSO_4$) filtered and stripped to afford the amide ester $$(C_{12}H_{25}—C_6H_4—O(C_4H_9O)_{\sim 18}\overset{O}{\overset{\|}{C}}\overset{O}{\overset{\|}{C}}N\langle\ )$$

of the monosuccinimide.

EXAMPLE 2

Into a 1 liter three-neck flask equipped with a mechanical stirrer and nitrogen sweep was placed 300 ml of dry toluene. The system was cooled to 0° C. and phosgene gas was bubbled in until 19.9 g was contained in the toluene. At this time, 165 g (0.10 mole) of tetrapropenylphenyl polyoxybutylene alcohol in toluene was added over 30 minutes. The system was warmed to room temperature and stirred at room temperature for 2 hours. At this time, excess phosgene was removed by vigorous sparging of the reaction system with nitrogen for 2 hours yielding a solution containing tetrapropenylphenyl polyoxybutylene chloroformate.

The methylene chloride solution containing the chloroformate derivative was then added to a composition containing 200 ml methylene chloride, 30 ml triethylamine and 406 g of a succinimide dispersant composition [prepared by reacting 1 mole of polyisobutenyl succinic anhydride, where the polyisobutenyl group has a number average molecular weight of about 950, with 0.87 mole of tetraethylene pentaamine; then diluting to about 35% actives with diluent oil]. The system was stirred at room temperature for 2 hours afterwards, the system was partially stripped, diluted with 1 liter hexane, extracted twice with brine (pH 8–9), dried ($MgSO_4$) filtered and stripped to afford the carbamate $$(C_{12}H_{25}—C_6H_4—O(C_4H_9O)_{\sim 18}\overset{O}{\overset{\|}{C}}N\langle\ )$$

of the monosuccinimide.

EXAMPLE 3

Into a 1 liter three-neck flask equipped, with a mechanical stirrer and nitrogen sweep is placed 200 ml of methylene chloride containing 18.9 g of oxalylchloride. To this mixture at room temperature is added dropwise a solution of methylene chloride containing 11.8 g (0.10 mole) of 2-butoxyethanol $$(CH_3CH_2\overset{CH_3}{\overset{|}{C}}H—OCH_2CH_2OH)$$

over 30 minutes. Upon completion of addition, the solution is stripped to remove methylene chloride and excess oxalyl chloride yielding the chlorodicarbonyloxy derivative $$(CH_3CH_2\overset{CH_3}{\overset{|}{C}}H—OCH_2CH_2O\overset{O}{\overset{\|}{C}}\overset{O}{\overset{\|}{C}}Cl)$$

The chlorodicarbonyloxy derivative is then redissolved in 300 ml methylene chloride.

The methylene chloride solution containing the chlorodicarbonyloxy derivative is then added to a composition containing 200 ml methylene chloride, 30 ml triethylamine and 406 g of a succinimide dispersant composition [prepared by reacting 1 mole of polyisobutenyl succinic anhydride, where the polyisobutenyl group has a number average molecular weight of about 950, with 0.87 mole of tetraethylene pentaamine; then diluting to about 35% actives with diluent oil]. The system is stirred at room temperature for 2 hours afterwards, the system is partially stripped, diluted with 1 liter hexane, extracted twice with brine (pH 8–9), dried ($MgSO_4$) filtered and stripped to afford the amide ester $$(C_2H_5\overset{CH_3}{\overset{|}{C}}—OCH_2CH_2O\overset{O}{\overset{\|}{C}}\overset{O}{\overset{\|}{C}}N\langle\ )$$

of the monosuccinimide.

EXAMPLE 4

Into a 2 liter three-neck flask equipped with a mechanical stirrer and nitrogen sweep was placed 300 ml of dry toluene. The system was cooled to 0° C. and phosgene gas was bubbled in until 59.7 g was contained in the toluene. At this time, 495 g (0.30 mole) of tetrapropenylphenyl polyoxybutylene alcohol in toluene was added over 30 minutes. The system was warmed to room temperature and stirred at room temperature for 2 hours. At this time, excess phosgene was removed by vigorous sparging of the reaction system with nitrogen for 2 hours yielding a toluene solution containing tetrapropenylphenyl polyoxybutylene chloroformate.

The toluene solution containing the chloroformate derivative was then added to a composition containing 300 ml methylene chloride, 90 ml triethylamine and 406 g of a succinimide dispersant composition [prepared by reacting 1 mole of polyisobutenyl succinic anhydride, where the polyisobutenyl group has a number average molecular weight of about 950, with 0.87 mole of tetraethylene pentaamine; then diluting to about 35% actives with diluent oil]. The system was stirred at room temperature for 2 hours afterwards, the system was partially stripped, diluted with 2 liter hexane, extracted twice with brine (pH 8–9), dried ($MgSO_4$) filtered and stripped to afford the carbamate $$(C_{12}H_{25}-C_6H_4-O-(C_4H_9O)_{\sim 18}\overset{O}{\overset{\|}{C}}N\!<\!)$$

of the monosuccinimide.

EXAMPLE 5

Into a 1 liter three-neck flask equipped with a mechanical stirrer and nitrogen sweep is placed 200 ml of methylene chloride containing 18.9 g of oxalylchloride. To this mixture at room temperature is added dropwise a solution of methylene chloride containing 10.4 g (0.10 mole) of 3-ethoxy-1-propanol ($CH_3CH_2OCH_2CH_2CH_2OH$) over 30 minutes. Upon completion of addition, the solution is stripped to remove methylene chloride and excess oxalyl chloride yielding the chlorodicarbonyloxy derivative $$(CH_3CH_2OCH_2CH_2CH_2O\overset{O}{\overset{\|}{C}}\overset{O}{\overset{\|}{C}}Cl).$$

The chlorodicarbonyloxy derivative is then redissolved in 300 ml methylene chloride.

The methylene chloride solution containing the chlorodicarbonyloxy derivative is then added to a composition containing 200 ml methylene chloride, 30 ml triethylamine and 406 g of a succinimide dispersant composition [prepared by reacting 1.0 mole of polyisobutenyl succinic anhydride, where the polyisobutenyl group has a number average molecular weight of about 950, with 0.5 mole of tetraethylene pentaamine; then diluting to about 35% actives with diluent oil]. The system is stirred at room temperature for 2 hours afterwards, the system is partially stripped, diluted with 1 liter hexane, extracted twice with brine (pH 8–9), dried ($MgSO_4$) filtered and stripped to afford the amide ester $$(CH_3CH_2OCH_2CH_2OC\overset{O}{\overset{\|}{C}}\overset{O}{\overset{\|}{C}}N\!<\!)$$

of the bis-succinimide.

EXAMPLE 6

(A) In the manner of Example 2, n-butoxyethoxyethanol ($n\text{-}C_4H_9OCH_2CH_2OCH_2CH_2OH$) was treated with phosgene to form the corresponding chloroformate $$(n\text{-}C_4H_9OCH_2CH_2OCH_2CH_2O\overset{O}{\overset{\|}{C}}Cl).$$

Into a 1-liter 3-neck round bottom flask was added 94 g of phenol, 79 g of pyridine, a 300 ml of toluene. The system was stirred at room temperature and, over a period of 40 minutes, 1 mole (approximately 224 g) of the above chloroformate was slowly added to the system. After reaction completion, the product was extracted with hexane. The organic layer was washed three times with brine and then dried over anhydrous magnesium sulfate. The solvent was removed by stripping to yield the carbonate:

$$(n\text{-}C_4H_9OCH_2CH_2OCH_2CH_2O\overset{O}{\overset{\|}{C}}OC_6H_5).$$

In a manner similar to (A) above, ethanol was used in place of phenol to yield the carbonate:

$$(n\text{-}C_4H_9OCH_2CH_2OCH_2CH_2O\overset{O}{\overset{\|}{C}}OC_2H_5).$$

(B) 71.8 g of the carbonate $$(n\text{-}C_4H_9OCH_2CH_2OCH_2CH_2O\overset{O}{\overset{\|}{C}}OC_6H_5),$$

prepared similarly to (A) above, was added to a 2liter reaction flask together with 472 g of a succinimide dispersant composition [prepared by reacting 1 mole of polyisobutenyl succinic anhydride, where the polyisobutenyl group has a number average molecular weight of about 950, with 0.5 mole of tetraethylene pentaamine; then diluting to about 50% actives in diluent oil and having an alkalinity value =29.7]. Initially, the combined system gave an alkalinity value =25.8. The system was then heated to 165° C. and stirred under a nitrogen atmosphere for 2 hours at which time the alkalinity value of the system was 14.5. The system was cooled to 80° C. and an additional 0.0255 moles (about 7.2 g) of carbonate was added. The system was heated to 165° C. and stirred under nitrogen for an additional 40 minutes to give a product having an alkalinity value of 13.6 and affording the carbamate $$(C_4H_9OCH_2CH_2OCH_2CH_2O\overset{O}{\overset{\|}{C}}N\!<\!)$$

of the bissuccinimide.

EXAMPLE 7

689 g of the carbonate $$(n\text{-}C_4H_9OCH_2CH_2OCH_2CH_2O\overset{O}{\overset{\|}{C}}OC_6H_5),$$

prepared similarly to the process described in Example 6 above, was added to a 5-liter reaction flask together with 1897.2 g of a succinimide dispersant composition [prepared by reaction 1 mole of polyisobutenyl succinic anhydride, where the polyisobutenyl group has a number average molecular weight of about 950, with 0.87 mole of tetraethylene pentaamine; then diluting to about 40 actives with diluent oil and having an alkalinity value of 48.0]. Initially, the combined system gave an alkalinity value of 26.3. The system was then heated to 165° C. and stirred under a nitrogen atmosphere for 1½ hours. The system was then cooled to about 90° C. while nitrogen sparging. The system was maintained at this temperature for 3 hours to give a product having an alkalinity value of 12.7 and affording the carbamate $$(C_4H_9OCH_2CH_2OCH_2CH_2O\overset{O}{\overset{\|}{C}}N\langle\ )$$

of the monosuccinimide.

What is claimed is:

1. A product prepared by the process which comprises contacting at a temperature sufficient to cause reaction:

(a) a compound selected from the group consisting of boric acid, boron oxides, boron halides and esters of boric acid; and (b) a polyamino alkenyl or alkyl succinimide wherein one or more of the notrogens of the polyamino moiety is substituted with $$R_4OR_5O\overset{O}{\overset{\|}{(C)}}_m\overset{O}{\overset{\|}{C}}-$$

wherein $R_4$ is hydroarbyl of from 1 to 30 carbon atoms; $R_5$ is selected from the group consisting of hydrocarbyl of from 2 to 30 carbon atoms and $-R_6-OR_6-_p$ wherein $R_6$ is alkylene of from 2 to 5 carbon atoms and p is an integer from 1 to 100; and m is an integer of from 0 to 1; wherein from about 0.1 equivalents to about 10 equivalents of (a) are employed per equivalent of (b).

2. A product produced by the process according to claim 1 wherein $R_4$ is hydrocarbyl of from 2 to 20 carbon atoms.

3. A product produced by the process according to claim 2 wherein the alkenyl or alkyl moiety is from about 20 to 300 carbon atoms.

4. A product produced by the process according to claim 3 wherein $R_5$ is a straight- or branched-chain alkylene group of from 2 to about 30 carbon atoms or a straight- or branched-chain alkylene group of from 2 to about 30 carbon atoms substituted with aryl of from 6 to 10 carbon atoms or alkaryl of 7 to 12 carbon atoms.

5. A product produced by the process according to claim 4 wherein $R_5$ is a straight- or branched-chain alkylene group of from 2 to about 30 carbon atoms.

6. A product produced by the proess according to claim 5 wherein m is 0.

7. A product produced by the process according to claim 5 wherein m is 1.

8. A product produced by the process according to claim 3 wherein $R_5$ is $-R_6-OR_6-$ wherein $R_6$ is alkylene of from 2 to 5 carbon atoms and p is an integer from 1 to 100.

9. A product produced by the process according to claim 8 wherein $R_6$ is alkylene of from 3 to 4 carbon atoms.

10. A product produced by the process according to claim 9 wherein p is an integer from 1 to 50.

11. A product produced by the process according to claim 10 wherein p is an integer from 2 to 20.

12. A product produced by the process according to claim 11 wherein m is 0.

13. A product produced by the process according to claim 11 wherein m is 1.

14. A product produced by the process according to claim 1 wherein $$R_4OR_5O\overset{O}{\overset{\|}{(C)}}_m\overset{O}{\overset{\|}{C}}- \text{ is } CH_3CH_2CH_2CH_2OCH_2CH_2OCH_2CH_2O\overset{O}{\overset{\|}{C}}-.$$

15. A product prepared by the process which comprises contacting at a temperature sufficient to cause reaction (a) a compound selected from the group consisting of boric acid, boron oxides, boron halides, and esters of boric acid; and (b) a compound of the formula

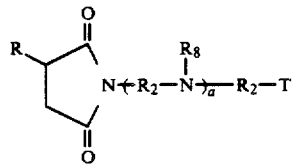

wherein R is alkenyl or alkyl of from 10 to 300 carbon atoms; $R_2$ is alkylene of from 2 to 10 carbon atom; a is an integer from 0 to 10; $R_8$ is hydrogen, lower alkyl of from 1 to 6 carbon atoms and $$-\overset{O}{\overset{\|}{C}}\overset{O}{\overset{\|}{(C)}}_mOR_5OR_4$$

werein m is an integer from 0 to 1; $R_4$ is hydrocarbyl of from 1 to 30 carbon atom, $R_5$ is a straight-or branched-chain alkylene group of from 2 to about 30 carbon atom or a straight- or branched-chain alkylene group of from 2 to about 30 carbon atoms substituted with aryl of from 6 to 10 carbon atoms or alkaryl of from 7 to 12 carbon atoms or $-R_6-OR_6-_p$ wherein $R_6$ is alkylene of from 2 to 5 carbon atoms and p is an integer from 1 to 100; T is

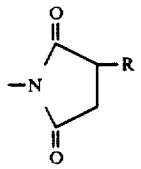

or $-NHR_8$ wherein R and $R_8$ are as defined above with the proviso that at least one of $R_8$ is $$-\overset{O}{\overset{\|}{C}}(\overset{O}{\overset{\|}{C}})_m OR_5OR_4;$$

wherein from about 0.1 equivalents to about 10 equivalents of (a) are employed per equivalent of (b).

16. A product produced by the process according to claim 15 wherein R is alkenyl or alkyl of from 20 to 300 carbon atoms.

17. A product produced by the process according to claim 16 wherein R is alkenyl or alkyl of from 20 to 100 carbon atoms.

18. A product produced by the process according to claim 17 wherein a is an integer of from 1 to 6.

19. A product produced by the process according to claim 18 wherein $R_2$ is alkylene of from 2 to 6 carbon atoms.

20. A product produced by the process according to claim 19 wherein R4 is hydrocarbyl of from 2 to 20 carbon atoms.

21. A product produced by the process according to claim 20 wherein $R_5$ is a straight- or branched-chain alkylene group of from 2 to about 30 carbon atom.

22. A product produced by the process according to claim 20 wherein $R_5$ is $-R_6-R_6-OR_6-_p$ wherein $R_6$ is alkylene of from 2 to 5 carbon atoms and p is an integer from 1 to 10.

23. A product produced by the process according to claim 22 wherein $R_6$ is alkylene of from 3 to 4 carbon atoms and p is an integer from 2 to 20.

24. A product produced by the process according to claim 19 wherein $$-\overset{O}{\overset{\|}{C}}(\overset{O}{\overset{\|}{C}})_m OR_5OR_4 \text{ is } -\overset{O}{\overset{\|}{C}}OCH_2CH_2OCH_2CH_2OCH_2CH_2CH_2CH_3.$$

25. A product produced by the process according to claim 19 wherein $$-\overset{O}{\overset{\|}{C}}(\overset{O}{\overset{\|}{C}})_m OR_5OR_4 \text{ is}$$

$$-\overset{O}{\overset{\|}{C}}COCH_2CH_2OCH_2CH_2OCH_2CH_2CH_2CH_3.$$

26. A lubricating oil composition comprising an oil of lubricating viscosity and a dispersant effective amount of a product produced by the process according to claim 1.

27. A lubricating oil composition comprising an oil of lubricating viscosity and a dispersant effective amount of a product produced by the process according to claim 15.

28. A lubricating oil concentrate comprising from about 90 to about 10 weight percent of an oil of lubricating viscosity and from about 10 to about 90 weight percent of a product produced by the process according to claim 1.

29. A lubricating oil concentrate comprising from about 90 to about 10 weight percent of an oil of lubricating viscosity and from about 10 to about 90 weight percent of a product produced by the process according to claim 15.

* * * * *

UNITED STATES PATENT AND TRADEMARK OFFICE

CERTIFICATE OF CORRECTION

PATENT NO. : 4,713,187

DATED : DECEMBER 15, 1987

INVENTOR(S) : THOMAS F. BUCKLEY, III ET AL.

It is certified that error appears in the above-identified patent and that said Letters Patent are hereby corrected as shown below:

Claim 1, col. 19, line 35, "notrogens" should read --nitrogens--.

Claim 1, col. 19, line 42, "hydroarbyl" should read --hydrocarbyl--.

Claim 6, col. 19, line 65, "proess" should read --process--.

Claim 8, col. 20, line 2, "$-R_6-OR_6-$" should read -- $-R_6\{OR_6\}_p$ --.

Claim 15, col. 20, line 55, "$-R_6-OR_6-_p$" should read -- $-R_6\{OR_6\}_p$ --.

Claim 22, col. 21, line 26, "$-R_6-R_6-OR_6-_p$" should read -- $-R_6\{OR_6\}_p$ --.

Signed and Sealed this

Fifth Day of July, 1988

*Attest:*

*Attesting Officer*

DONALD J. QUIGG

*Commissioner of Patents and Trademarks*